US008646841B2

(12) United States Patent
Molnar

(10) Patent No.: US 8,646,841 B2
(45) Date of Patent: Feb. 11, 2014

(54) SEAT WITH A NON-VERTICAL CENTRAL SUPPORTING COLUMN AND TRI-PLANAR MOVEABLE BASE

(76) Inventor: Mary Ann Molnar, San Francisco, CA (US)

( * ) Notice: Subject to any disclaimer, the term of this patent is extended or adjusted under 35 U.S.C. 154(b) by 216 days.

(21) Appl. No.: 12/806,483

(22) Filed: Aug. 13, 2010

(65) Prior Publication Data

US 2011/0109141 A1 May 12, 2011

Related U.S. Application Data

(60) Provisional application No. 61/274,293, filed on Aug. 13, 2009.

(51) Int. Cl.
*A47C 1/00* (2006.01)

(52) U.S. Cl.
USPC ..... 297/344.21; 297/451.5; 297/452.21

(58) Field of Classification Search
USPC ..... 297/263.1, 263.2, 344.16, 344.21, 297/344.26, 451.5, 452.21, 452.23, 452.25
See application file for complete search history.

(56) References Cited

U.S. PATENT DOCUMENTS

| | | | | | |
|---|---|---|---|---|---|
| 229,733 | A | * | 7/1880 | Michaels | 297/263.2 |
| 3,840,205 | A | * | 10/1974 | Faull | 248/582 |
| 4,099,697 | A | * | 7/1978 | Von Schuckmann | 248/604 |
| 4,932,719 | A | | 6/1990 | Gonzalez y. Rojas | |
| 4,977,848 | A | * | 12/1990 | Currey | 114/363 |
| 5,112,103 | A | | 5/1992 | Downer | |
| 5,163,737 | A | * | 11/1992 | Navach et al. | 297/452.25 |
| 5,536,067 | A | * | 7/1996 | Pinto | 297/284.11 |
| 5,590,930 | A | * | 1/1997 | Glockl | 297/313 |
| 5,630,648 | A | | 5/1997 | Allard | |
| 5,833,319 | A | * | 11/1998 | Davis | 297/452.21 |
| 5,873,628 | A | | 2/1999 | Alard | |
| 6,155,642 | A | * | 12/2000 | Kawakami et al. | 297/344.16 |
| 6,752,460 | B2 | * | 6/2004 | Looser | 297/338 |
| 6,811,218 | B2 | | 11/2004 | Deimen | |
| 6,834,916 | B2 | | 12/2004 | Volkman | |
| 6,959,965 | B2 | * | 11/2005 | Diffrient | 297/320 |
| 7,293,825 | B2 | | 11/2007 | Vergera | |
| 2003/0164633 | A1 | * | 9/2003 | Jakus et al. | 297/271.5 |
| 2007/0057562 | A1 | * | 3/2007 | Gregory et al. | 297/452.21 |
| 2007/0298945 | A1 | * | 12/2007 | Mehta | 482/130 |

FOREIGN PATENT DOCUMENTS

WO WO2008/142179 * 11/2008

* cited by examiner

*Primary Examiner* — Philip Gabler
(74) *Attorney, Agent, or Firm* — Charles S. Guenzer

(57) ABSTRACT

An ergonomic pedestal seat that interacts with the sitter's musculoskeletal system in a way that optimizes their use of gravitational forces is provided. This seat orients a sitter toward an alignment that encourages a balance between gravity's descending force and its ascending counterforce, the ground reaction force. The seat comprises a four-tier seat base, a non-vertical central supporting column and a contoured seat pan. The base has a surface that allows the sitter to sustain a stable alignment and to rock forward or sideward or both, as well as a Lazy Susan mechanism that permits turning. This seat supports the sitter through a range of seated activities, including quiet activities such as meditation and complex tasks requiring reaching, bending and turning. When on this seat sitting becomes a source of pleasure rather than an activity of drudgery.

20 Claims, 8 Drawing Sheets

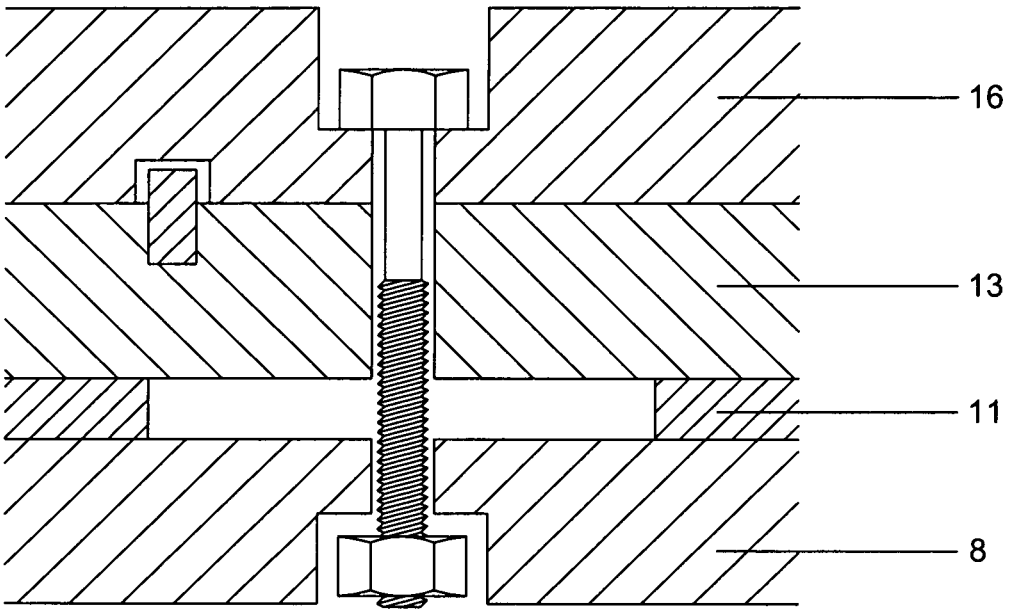
Fig. 4 Four tier attachment detail

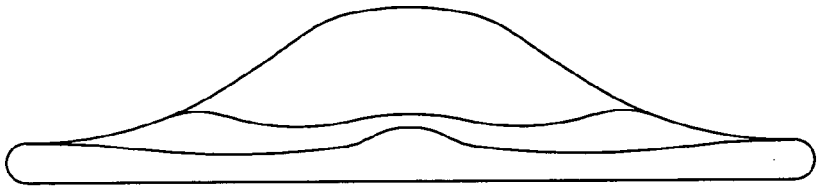
Fig. 5 Front view of seat pan
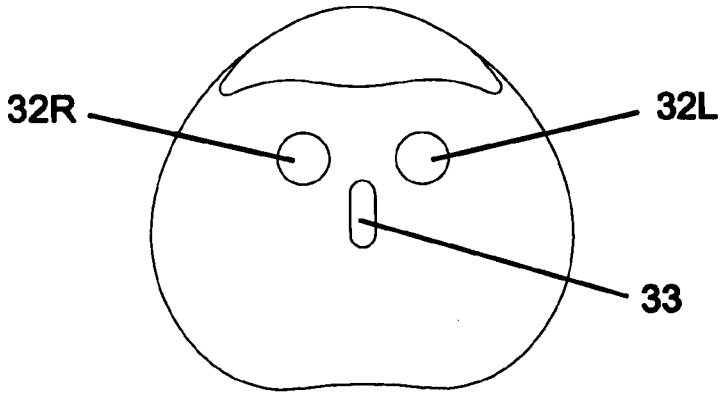
Fig. 6 Top view of seat pan

Fig. 7 Contour Cutting Jig

SEAT WITH A NON-VERTICAL CENTRAL SUPPORTING COLUMN AND TRI-PLANAR MOVEABLE BASE

CLAIM OF PRIORITY

This patent application claims priority under 35 USC 119 (e) (1) from U.S. Provisional Patent Application Ser. No. 61/274,293 filed Aug. 13, 2009 of Mary Ann Molnar and John Moldovan entitled, "Seat with a Non-Vertical Central Supporting Column and Tri-Planar Moveable Base."

FIELD OF THE INVENTION

The present invention pertains to the field of seating, and more specifically to the field of ergonomic seating and even more specifically to the field of ergonomic pedestal seating.

BACKGROUND OF THE INVENTION

The prior art has put forth several designs for pedestal seating. Among these are:

U.S. Pat. No. 4,932,719 to Enrique M. Gonzalez y. Rojas describes an inclinable stool comprising a tripod base.

U.S. Pat. No. 5,112,103 to Stephen H. Downer describes a pedestaled seat useful as a gardening stool that can also be used on hard surfaces comprising a rounded base which allows the stool to be rocked.

U.S. Pat. Nos. 5,630,648 and 5,873,628 to Peter B. Allard, Jack K. Hockenberry and Harry C. Sweere describe a dynamic posture chair which is capable of use in a range of sit/stand positions. The chair includes a mobile base that is selectively moveable by the user and the chair member that is mounted to the base with a tilt mechanism that enables the chair member to be selectively and infinitely tilted over a predetermined tilt position while resistively restraining the chair member in the selected tilt position.

U.S. Pat. No. 6,811,218 to Michael L. Deimen, Derek Schwelkarth, Stephen D. Hatcher and Joseph G. Hasenour describes a chair with conforming seat which comprises a seating surface including rigid and flexible portions connected to one another, wherein the flexible portions allow resilient flexing of the seating surface to create conformance zones which dynamically support a seated user in an ergonomic manner.

U.S. Pat. No. 6,834,916 to Cheryl Volkman, Dianne Goodwin and Sherry Rovig describes a gardening stool that allows for tilting and pivoting having an elongated base connected to a seat by a post. The elongated base is convex and is tapered toward the front for pivoting. The base may include a flattened region located toward the rear of the post for stability.

U.S. Pat. No. 7,293,825 to Alexander Vergara and Harold Turner describes multi-position chair which is capable of one or more sitting positions at different heights, one or more leaning positions at different angles, and one or more storage positions.

None of these references describe the present invention.

SUMMARY OF THE INVENTION

The present invention provides a seat that interacts with sitter's musculoskeletal systems in a way that optimizes their use of gravitational forces. This seat assists a sitter to identify an alignment that reduces the magnitude of gravity's compressive forces and increases their access to gravity's counterforce, the ground reaction force. When this occurs a sitter senses a mild force lifting the weight of their body upwards, effectively neutralizing gravity's downward pull. Sitting becomes a source of pleasure rather than an activity of drudgery.

This seat provides an ideal support for a sitter through a broad range of seated activities. It holds them in an optimal skeletal alignment during both simple seated tasks requiring stability, such as praying or meditating, and complex seated tasks requiring varying degrees of mobility, such as reaching, bending and turning. Additionally, this seat assists a sitter to shed the common stresses and poor habits associated with prolonged sitting, i.e., discomfort, fatigue, stiffness, weakness and the accumulation of awkward postures. This seat becomes an interactive companion, capable of gradually teaching a sitter how to live compatibly with the laws of balance and motion.

The seat of the present invention provides the following advantages over conventional seating. The seat becomes an integral link in the communication system between sitter and the earth, and provides an interactive base for both stability and mobility. The non-vertical central supporting column interacts with sitter's body as if it were an extension of their spine and facilitates an advantageous interaction with gravity's forces. The seat pan holds the sitter's pelvis and hips in an alignment that opens a passageway through which gravity's forces travel vertically without interruption. The seat base interacts with a sitter's body as if it were a combined ankle and foot complex, thereby allowing them to move from the bottom "joint" while remaining stable in their torso during activities requiring mobility, i.e., reaching, bending or turning.

The seat design is applicable to a wide selection of seated activities. It provides an ideal support for sitters while praying or meditating, eating, writing, reading, studying, typing at a keyboard, and during creative work such as playing a musical instrument, or drawing and painting. The seat design is based predominantly on the geometry of the sitter's interactions with the earth. The seat relies on the sitter's personal use of weight, balance and motion for its operation. The seat is adaptable for individual fit with only one lever, a seat height adjustment.

The seat is easily moved from location to location.

A sitter using the seat of the present invention may experience many advantages including, but not limited to: an increased ability to identify a personal and comfortable "home base" alignment that is sustainable during prolonged seated tasks; a decrease in the effort needed to complete the seated task-at-hand as sitters no longer need to struggle and squirm while in their seat; an increase in the level of musculoskeletal comfort and mobility, as erratic musculoskeletal forces are minimized; a decrease in the muscular tension required to maintain an upright posture, even for extended periods of time; a sense of increased spaciousness, or reduced restriction, within their chest, abdomen and or pelvis, thus facilitating optimal functioning of the internal organs, i.e., heart, lungs and digestive system; an increase in the stamina, mental clarity and concentration available for focused tasks along with an increase in productivity and mastery; and an increase in the pleasure of walking and other activities of life as the influence of sitting at their best effects their whole body.

The seat of the present invention has a non-vertical central supporting post that acts as if it were extending the spine downward from the sacrum through the pelvis to the seat base to the floor. The non-vertical supporting column is tilted forward about two to three degrees with respect to a line perpendicular to the floor.

The base of the seat of the present invention is in contact with the floor and provides a continuous and direct connection for the body with the floor and to the center of the earth.

In the seat of the present invention all motion and action, with the exception of the seat height adjustment, such as rocking, tilting and rotation, occurs within the base of the seat, and independently of each other.

The base of the seat of the present invention is sensitive to small changes in the motion, position and location of sitter's center of gravity of their torso and responds with appropriate rocking, tilting and turning motions at the base of the seat. This seat has the unique ability to rock forward, sideward, and diagonally and limits the ability to rock backwards, ensuring the safety of the sitter.

The seat pan is aligned over the non-vertical supporting column such that the location of the sitter's "sit bones" and the location of the center of gravity of the sitter's torso line up with a line extending from the non-vertical supporting column upward through the sitter's body to the top of their neck, essentially following the two degree angle of tilt.

BRIEF DESCRIPTION OF THE DRAWINGS

FIG. 4 shows the four tier attachment detail.

FIG. 5 shows a front view of the seat pan.

FIG. 6 shows a top view of the seat pan.

DETAILED DESCRIPTION

Figure 1:
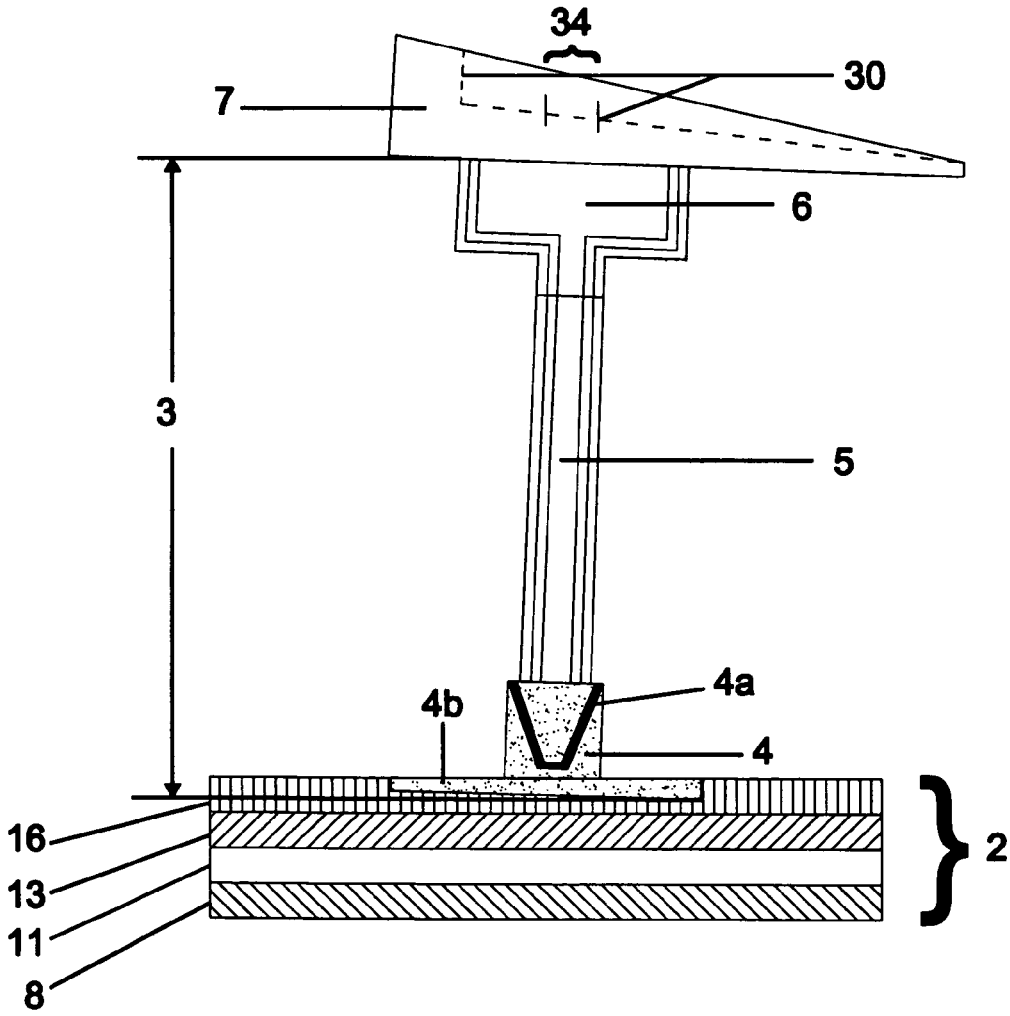
FIG. 1 shows a schematic side view of the seat. This figure shows the seat pan with straight lines, however, the actual seat pan is curvilinear as can be seen from FIGS. 5 and 6.

For convenience, following is set forth a list of drawing reference numerals and the elements to which they refer:

1—Seat
2—Four-Tier Seat Base
3—Non-Vertical Central Supporting Column
4—Gas Cylinder Mount
5—Gas Cylinder
6—Gas Cylinder Release and Seat Pan Mounting Unit
7—Contoured Seat Pan
8—Bottom Tier of the Four-Tier Seat Base 2
9—Bottom Surface of the Bottom Tier 8
10—Top Surface of the Bottom Tier 8
11—Lazy-Susan Mechanism
12—Screws for installing the Lazy Susan Mechanism 11
13—Middle Tier of the Four-Tier Seat Base 2
14—Bottom Surface of the Middle Tier 13
15—Top Surface of the Middle Tier 13
16—Top Tier of the Four-Tier Seat Base 2
17—Bottom Surface of the Top Tier 16
18—Top Surface of the Top Tier 16
19—Dowel to Prevent Rotation of the Top Tier 16 on the Middle Tier 13 and Bottom Tier 8 of the Four-Tier Seat Base 2
20—Hole for Base-Anchoring Carriage Bolt of the Four-Tier Seat Base 2
21—Base-Anchoring Carriage Bolt
22—Locknut Indentation Area on the Bottom Surface of the Bottom Tier 9 of the Four-Tier Seat Base 2
23—Locknut
24—Central Resting Point of the Bottom Surface of the Top Tier 17 of the Four-Tier Seat Base 2
25—Central Stability Area of the Bottom Surface of the Top Tier 17 of the Four-Tier Seat Base 2
26—Posterior Flat Surface of the Bottom Surface of the Top Tier 17 of the Four-Tier Seat Base 2
27—Slanted-Convex Surface of the Bottom Surface of the Top Tier 17 of the Four-Tier Seat Base 2
28—Dowel Mortise for Dowel 19 on the Bottom Surface of the Top Tier 17 of the Four-Tier Seat Base 2
29—Indented Central Region for the Gas Cylinder Mount 4 on the Top Surface of the Top Tier 18 of the Four-Tier Seat Base 2
30—Top Surface of the Contoured Seat Pan 7
31—Posterior Sacrum/Coccyx Supporting Surface of the Top Surface of Contoured Seat Pan 30
32R—Right "sit bones" Concave Contour of the Top Surface of the Contoured Seat Pan 30
32L—Left "sit bones" Concave Contour of the Top Surface of the Contoured Seat Pan 30
33—Central Pelvic Floor Indentation of the Top Surface of the Contoured Seat Pan 30
34—Balance Region for Upper Body on the Top Surface of the Contoured Seat Pan 30
35—Slanted Seat Pan Contour
36R—Right Lateral Upper Thigh Support of the Top Surface of the Contoured Seat Pan 30
36L—Left Lateral Upper Thigh Support of the Top Surface of the Contoured Seat Pan 30
37—Midline Elevated Contour of the Top Surface of the Contoured Seat Pan 30
38—Depth of the Seat Pan
39—Bottom Surface of the Contoured Seat Pan 7
40—Anterior Indentation on the Bottom Surface of the Contoured Seat Pan 39
41—Posterior Indentation on the Bottom Surface of the Contoured Seat Pan 39.

Components of the Seat:

The following is a description of the seat components starting at the bottom of the seat and proceeding to the top of the seat. They are: A Four-Tier Seat Base 2; A Non-Vertical Central Supporting Column 3; and A Contoured Seat Pan 7.

The Four-Tier Seat Base 2

The Four Tier Seat Base 2 is comprised of six components as follows, starting at the bottom and proceeding upwards:

1. A Bottom Tier 8 (also referred to as Tier 1) of the Four Tier Base 2 is essentially round, any suitable diameter, for example, any diameter from about 13 inches to about 24 inches, and more specifically approximately 18 to 20 inches in diameter and flat on both the Bottom Surface 9 and the Top Surface 10. It is approximately 0.75 inch in height. The bottom surface is flat, smooth and contacts the floor. The bottom surface is smooth to facilitate easy sliding of the seat on the floor or carpet. The top surface is flat and is the base for the next component of the Four-Tier Seat Base 2.

Figure 3:
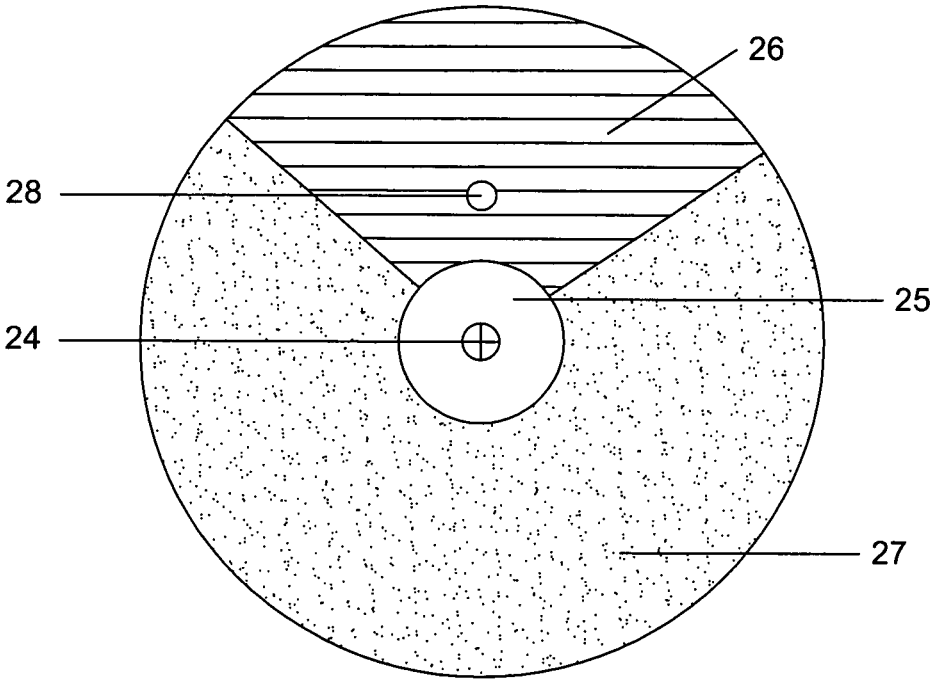
FIG. 3 shows the contours of the bottom surface of the top tier of the four-tier seat base.

2. Tier 2 is referred to as the Lazy-Susan Mechanism 11, is attached to the Top Surface of the Bottom Tier 10 and the Bottom Surface of the Middle Tier 14 (Tier 3) with Screws 12 or other fastening means, such that the center of the Lazy-Susan Mechanism 11 and the center of the Bottom Tier 8 and Middle Tier 12 are congruent if the diameter of the middle tier is equal to the diameter of the middle tier. The Lazy Susan mechanism comprises any suitable swivel device such as ball bearings in a circular race, or a disc inside a disc, or any other configuration which allows rotation of the device.
3. A Middle Tier 13, also referred to as Tier 3 of the Four Tier Base 2 is essentially round, equal in diameter, and height to the Bottom Tier 8, or slightly smaller, such as approximately 13 inches to about 24 inches, and more specifically approximately 17 inches in diameter and flat on both the bottom and top surfaces. The Bottom Surface of the Middle Tier 14 attaches to the Lazy Susan Mechanism 11, effectively Tier 2, with screws 12. The Top Surface of the third, or middle Tier 15 is flat except for the insertion of a Dowel to Prevent Rotation 19 of the Top Tier on the Bottom Tier. The Top Surface of the Middle Tier 15 is the base of support for the next component of the Four Tier Seat Base 2.
4. The Top Tier 16 of the Four Tier Seat Base 2 is essentially round and equal in diameter and height to the Middle Tier 13 and Bottom Tier 8. Alternatively, the top tier can be of decreasing diameter to the middle tier, for example, 13 to 20 inches in diameter, and more specifically, approximately 15 inches in diameter. The Bottom Surface of the Top Tier 17 is uniquely and symmetrically contoured with respect to the sagittal plane, i.e., from right to left, and asymmetrically contoured with respect to the frontal plane, i.e. from front to back. These contours allow the seat above to rock forward or sideward or both with respect to the Middle Tier 13 when the sitter is moving their center of gravity of their torso forward or sideward or both. The bottom surface of the Top Tier functions similar to the bottom of a conventional rocking chair; however, in contrast to a conventional rocking chair, this seat rocks forward and sideward and does not rock backward. These contours provide two specific areas of stability and one area of mobility depending on the way in which the Top Tier 16 is contacting the surface below, i.e., the Top Surface of the Middle Tier 15. These areas are shown in FIG. 3. Stability for a sitter is provided by two areas. They are: the Central Stability Area 25 is a flat area located at the center of the Bottom Surface of the Top Tier 17; it is approximately 3 inches in diameter, the center of which marks the Central Resting Point 24 of the seat as a whole. The second area is the Posterior Flat Surface 26 is a flat, ninety degree triangular segment with the right angle of the triangle located at the Center Resting Point 24 and extending to the posterior circumference of the Bottom Surface of the Top Tier 17. This area prevents the seat from tipping over backwards if and when the sitter shifts their center of gravity toward the back of the seat.

Figure 8:
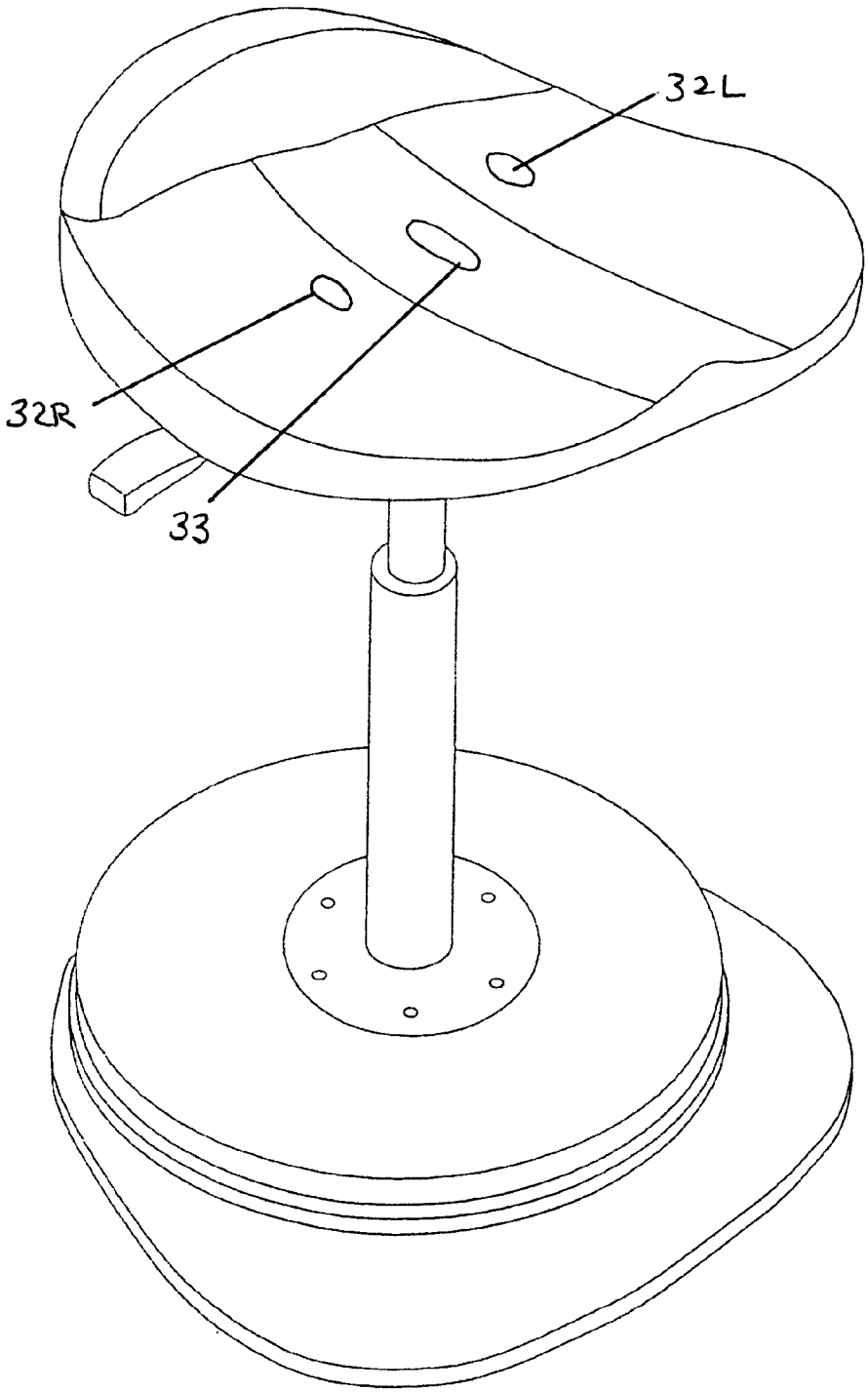
FIG. 8 shows a front top perspective view of the seat of the present invention showing the contoured seat pan.
Figure 9:
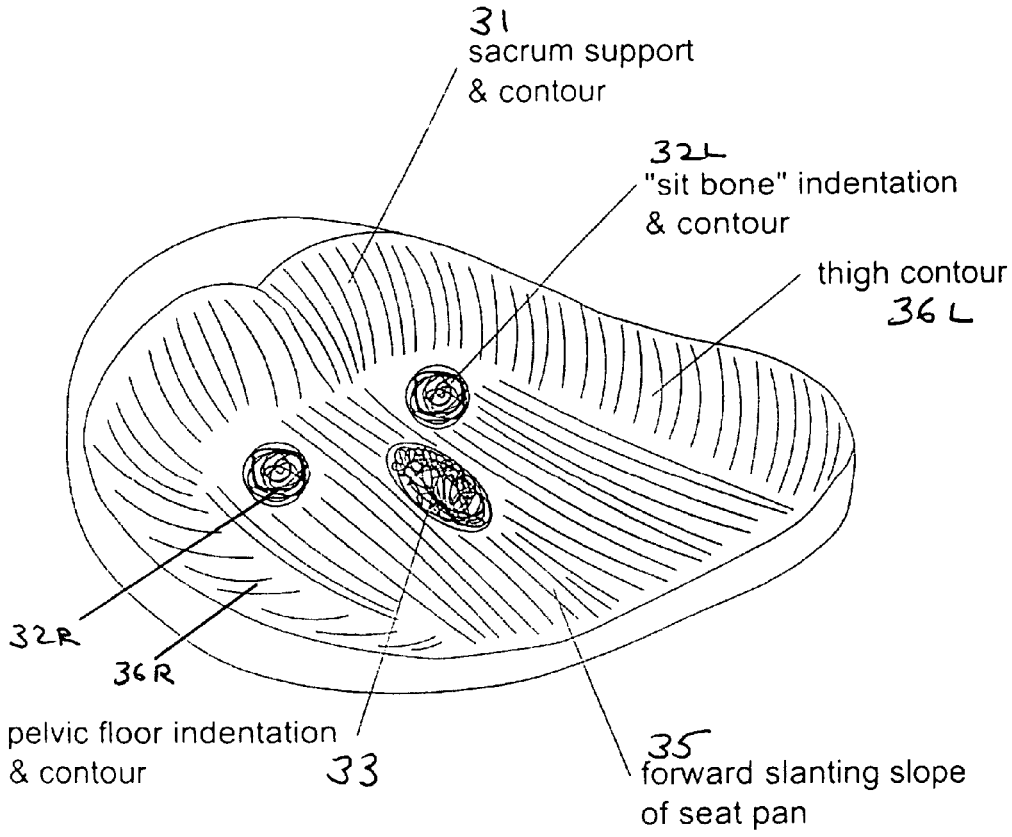
FIG. 9 is a top perspective view of the seat pan of the seat of the present invention showing contours and indentations hereinafter described.

It should be noted that the four tiers of the seat base can be of equal diameters or of decreasing diameters from the bottom tier to the top tier. This feature can be seen in FIG. 8. Decreasing diameters of the tiers adds stability to the seat. FIG. 1 shows the tiers of equal diameter. It is important that the centers of the top tier, middle tier and Lazy Susan mechanism be congruent, meaning the centers be directly on top of each other, regardless of whether the diameters are equal or decreasing. Placement of the top tier, middles tier and Lazy Susan mechanism over the bottom tier depends upon the shape of the bottom tier and the desired amount of stability for the seat. The bottom tier can be larger to increase to stability.

It should also be noted that although the tiers are described as being essentially round, oval, or other shapes are also suitable.

The area that provides mobility, the Slanted-Convex Surface 27 of the Bottom Surface of the Top Tier 17 of the Four Tier Seat Base 2, allows the seat to rock forward or sideward with respect to the Center Stability Area 25 of the Bottom Surface of the Top Tier 17 of the Four Tier Seat Base 2. The seat rocks forward or sideward or both when the sitter shifts their center of gravity forward or sideward or both with respect to the Center Stability Area 25 of the Bottom Surface of the Top Tier 17 of the Four Tier Seat Base 2. The Slanted-Convex Surface 27 has a graduating convex contour extending from the Central Stability Area 25 to the anterior and lateral circumference of the Top Tier 16. It simultaneously slants and curves convexly toward the perimeter of the Top Tier of the Four Tier Seat Base 16. The maximum forward tilt allowed is approximately five to eight degrees.

The Top Surface of the Top Tier 18 is flat except for an Indented Central Region 29; this surface is cut at a slight angle, sloping downward about 2 degrees from the back to the front of the Top Tier 18. This surface will receive the next component of the Four-Tier Seat Base 2.

5. An approximately 0.375 inch diameter Dowel 19 is glued into the Top Surface of the Middle Tier 15 about 2 inches posterior to the Central Stability Area 25 in order to prevent the Top Tier 16 from rotating relative to the Middle Tier 13 and the Bottom Tier 8. It slips into a Dowel Mortise 28 in the Bottom Surface of the Top Tier 17 where the Dowel Mortise 28 is slightly larger than the Dowel 19 to allow slippage when tilting the seat.
6. A Base-Anchoring Carriage Bolt 21 holds the Bottom Tier 8, Middle Tier 13 and Top Tier 16 together as a unit. A hole is drilled through the center of each of the three tiers to allow the bolt to pass from the Top Tier 16 through the Bottom Tier 8. It is secured with a Locknut 23 in the Locknut Indentation Area 22 on the Bottom Surface of the Bottom Tier 9 of the Four-Tier Seat Base. 2

The four tier base provides the sitter with the ability to establish a stable seated balance and to select a comfortable seated position within a continuous 270 degree range of seated positions that allow increasing amounts of tilt to the right, left, forward and on the diagonal as needed. Conventional seats do not address the need to be statically and dynamically balanced in multiple positions simultaneously.

The four tier base also provides the sitter with the ability to rotate the seat independently of the rocking motion. Because of this design, the sitter and seat base will always face forward when the sitter turns, allowing the sitter to maintain their alignment of balance and action in their new position. The present invention provides a new location for the rotational mechanism, and a new use for the Lazy-Susan mechanism in seating. Conventional seating provides the rotational function of a seat commonly placed at the seat level or within the supporting post.

The Non-Vertical Central Supporting Column 3

This component is composed of three components as follows, starting at the bottom and proceeding upwards: The Gas Cylinder Mount 4 is comprised of an internally tapered tube 4*a* welded to a flat circular base 4*b*, approximately 7 inches in diameter, with holes for 6 screws evenly spaced on the circumference. It fits into the Indented Central Region 29 on the Top Surface of the Top Tier 18 of the Four-Tier Seat Base 2, such that it fits evenly with the top surface of the base. The second component is Gas Cylinder 5. This unit is self-explanatory for those of ordinary skill in the art. The third component is Gas Cylinder Release and Seat Pan Mounting Unit 6. This unit is self-explanatory for those of ordinary skill in the art.

The Contoured Seat Pan 7

The third component is reduced in depth by approximately one-third when compared to the design of conventional seats. It is designed to support the pelvis and proximal one-third of sitter's thighs. Additionally, the Top Surface of the Contoured Seat Pan 30 slopes slightly downward from the posterior to anterior aspects at an angle of approximately 2 degrees. The Top Surface of the Contoured Seat Pan 30 has five additional contours. These are: A Posterior Sacrum/Coccyx Supporting Surface 34; Right and Left "sit bone" Concave Contours 32R and 32L; A Central Pelvic Floor Indentation 33; Right and Left Lateral Upper Thigh Supports 36R and 36L; and an optional Elevated Midline Contour 37 between the thighs near the anterior perimeter of the Contoured Seat Pan 7 edge.

The Bottom Surface of the Contoured Seat Pan 39 has two indentations, one to the front of the seat pan, known as the Anterior Indentation on the Bottom Surface of the Contoured Seat Pan 40 and one to the back of the seat pan, known as the Posterior Indentation on the Bottom Surface of the Contoured Seat Pan 41. These are finger holds for moving the Seat from location to location.

The seat pan has several unique features that support the pelvis and encourage a comfortable base of support for the torso.

The seat pan is reduced in depth by about ⅓ of the normal seat pan. The seat pan is designed to support the proximal ⅓ of the sitter's thigh. Most conventional seat pans support the full length of the sitter's thigh or nearly so.

The seat pan is shaped in a triangular configuration, with an increase in width at the front of the seat to accommodate the shape of the combined pelvis and thighs. Conventional seat pans are commonly found in square or circular shapes.

The back edge of the seat pan (where the buttock sit) is higher than the than the front edge (at the thigh), thus creating a tilt of approximately 2 degrees within the seat pan itself. Conventional seat pans are commonly designed with a flat contour, a dome shape, or with the posterior region lower than the anterior region.

The seat pan has a sacrum-supporting surface to the back of the seat that molds the shape of the buttocks and provides a surface for the sacrum to rest against. This discourages a posterior tilt and encourages an anterior tilt of the pelvis. Sacrum supports are rarely found on a seat without a back; lumbar supports are found on seats with a back, not sacrum supports.

The side edges of the seat pan are slightly tilted toward the center of the seat pan, thus encouraging the thighs to fall forward from the hip joint rather that in an open or overly abducted pathway. This assists in the formation of a triangular alignment of the legs and feet with the base of the seat. Conventional seat pans are commonly designed with flat side edges, or convex or concave shapes; the legs are allowed freedom to fall where they may or they are constrained to a rolled inward position.

Within the seat pan where the "sit bones" meet the seat surface, is a small indentation to receive the "sit bones." In front of this indentation is slight rise to support the length of the thigh just anterior to the "sit bones."

Making the Contoured Surface on the Bottom of the Top Tier

Figure 7A:
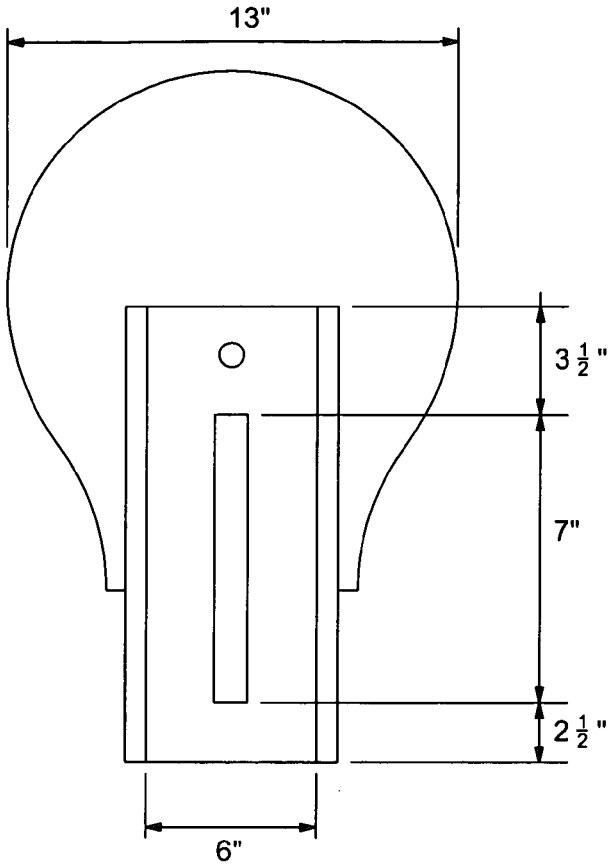
FIG. 7*a* shows a top view of the contour cutting jig for making the contoured bottom surface of the top tier of the seat base of the present invention.
Figure 7B:
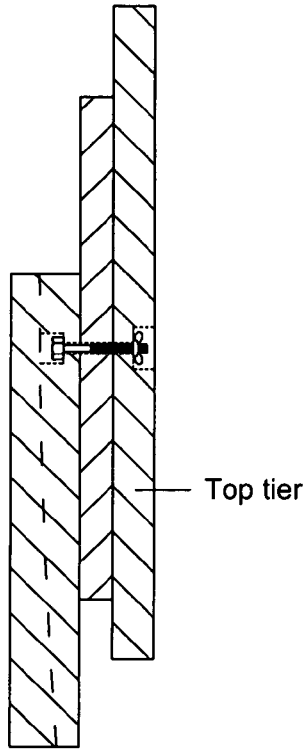
FIG. 7*b* shows a side view of the contour cutting jig for making the contoured bottom surface of the top tier of the seat base of the present invention
Figure 7C:
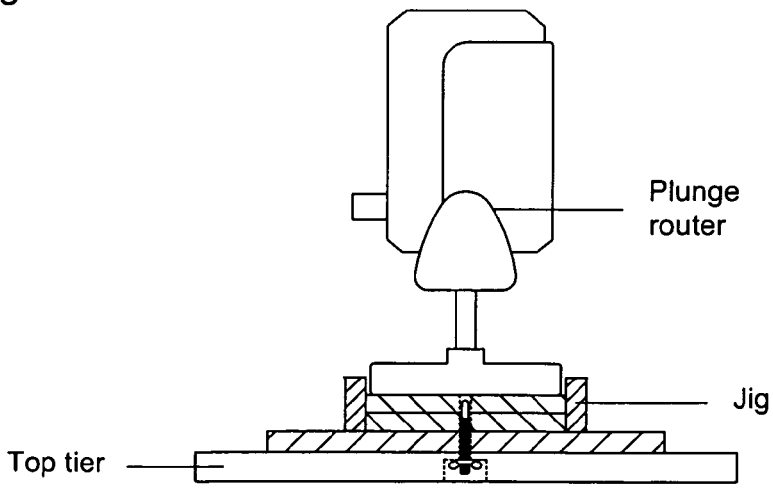
FIG. 7*c* shows a side front view of the contour cutting jig for making the contoured bottom surface of the top tier of the seat base of the present invention.

If the seat is made of wood, the contoured surface on the bottom of the top tier is made using contour cutting jig shown in FIGS. 7*a*, 7*b*, and 7*c*. Align top tier 16 so that the wood grain runs vertical. Mark a 90 degree triangle from the center to the top (or back) of the Top Tier. This area will remain flat. Attach the jig using 0.25 inch carriage bolt and wing nut. Align the jig with one of the triangle lines. Place a plunge router onto the top of the ramp of the jig and plunge down until the bit touches the surface of the top tier. Lock the router in that position, turn the router on and make the first cut by pulling the router down the ramp. Turn the router off and rotate the jig for the next cut. Push the router to the top of the ramp, turn it on and make the next cut. Make sure there is slight overlap of each cut. Repeat the aforementioned steps until the second line of the triangle is reached. Disassemble the jig. Using a random orbital sander with 220 grit sand paper, sand the entire surface that has been routed until smooth. Check for an even surface and consistent slope using a stiff, high quality straight edge. Re-sand where necessary.

Assembly of Seat:

The seat is assembled in five steps.

Figure 2:
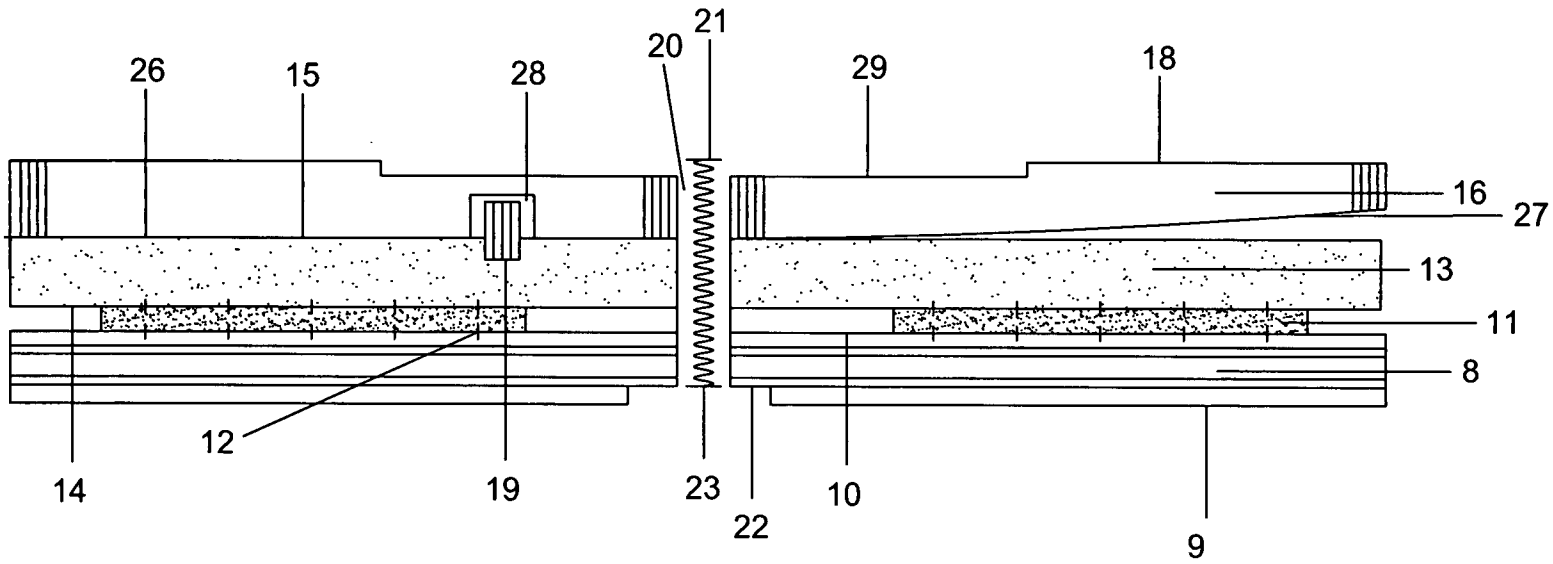
FIG. 2 shows a cut-away side view of the four tier seat base.

1. Assembly of the Four-Tier Seat Base 2:

The assembly of the Four-Tier Seat Base 2 occurs in this way: The Hole for the Base-Anchoring Carriage Bolt 20 is used to assemble the Top, Middle and Bottom Tiers as a unit. The Top, Middle and Bottom Tiers are arranged in order from bottom to top. See FIG. 2. A Base-Anchoring Carriage Bolt 21 is dropped through the Hole for the Base-Anchoring Carriage Bolt 20 now assembled from top to bottom. It is secured at the bottom with a Locknut 23. The Locknut 23 fits into a Locknut Indentation Area 22, which is 1 0.5 inch in diameter, preserves the flatness of the bottom and makes the Locknut 23 hand-accessible. The Four-Tier Seat Base 2 is now functional as a single unit.

2. Assembly of the Gas Cylinder Mount 4 and Top Tier of the Four-Tier Seat Base 16:

The Gas Cylinder Mount 4 is attached at the Indented Central Region 29 on the Top Surface of the Top Tier 18 of the Four-Tier Seat Base 2 in a specific way. It is positioned such that one screw is placed directly to the back of the seat. Then the Gas Cylinder Mount 4 is screwed in place with each of the six screws. This Indented Central Region 29 tips the Gas Cylinder Mount 4 and all structures above it by a minimal but significant amount. This is one of the unique design features of this seat; it assists in aligning sitters' spines such that gravity's forces are optimized within three-dimensional space.

3. Assembly of Gas Cylinder 5 to the Gas Cylinder Mount 4

The Gas Cylinder 5 fits into the Gas Cylinder Mount 4 and is anchored there with vertical pressure.

4. Assembly of the Gas Cylinder 5 to the Gas Cylinder Release and Seat Mounting Unit 6:

The Gas Cylinder Release and Seat Pan Mounting Unit 6 fits onto the Top end of the Gas Cylinder 5 and is anchored there with vertical pressure.

5. Assembly of the Contoured Seat Pan and Gas Cylinder Release and Seat Pan Mounting Unit 6:

The assembly of the Contoured Seat Pan 7 to the Gas Cylinder Release and Seat Pan Mounting Unit 6 and Gas Cylinder 5 underneath occurs with a special alignment. The Contoured Seat Pan 7 is attached to the Gas Cylinder Release and Seat Pan Mounting Unit 6 with four screws after it is aligned directly over the center of the Gas Cylinder 5 such that the center of the region supporting the sitter's "sit bones" and hips, known as the Balance Region for Upper Body on Contoured Seat Pan 34 is centered over of the Gas Cylinder 5. Thus Contoured Seat Pan 7 is placed anteriorly on the Non-Vertical Central Supporting Column 3 when compared to current seat designs. Also note that because the Non-Vertical Central Supporting Column 3 is aligned at a slightly acute angle with respect to the vertical axis in the sagittal plane, the Contoured Seat Pan 7 sits at a slightly downward slant with respect to the horizontal axis. Please see FIG. 1 for an illustration of this alignment.

Use of the Seat

This is a seat on which a sitter can learn to sit comfortably and with biomechanical efficiency. A sitter is required to learn six basic skills in order to use this seat in a way that will optimize their alignment in space and their appropriate use of gravity's forces during both simple and complex seated tasks. These include, in order: to sit in or on the seat pan in a way that supports their spine at its base, i.e., the coccyx and sacrum; to identify an optimal midline alignment while in the stable position, i.e., balanced over the Central Stability Area of the Bottom Surface of the Top Tier 25; to use their upper-body weight to rock the seat forward or sideward or both by tipping forward or sideward or both at their chest; this movement will be used during forward, sideward or diagonally oriented dynamic tasks; to rock the seat from its base as described above while maintaining a midline alignment within their pelvis and torso; to rotate the seat from its base using a Lazy Susan Mechanism 11; and to use their legs to actively to maintain a dynamic tripod base of support between their feet and the seat base.

A sitter learns to use the following actions for performing seated tasks requiring stability and mobility as follows: to perform upright and stable seated activities, such as prayer or meditation a sitter takes the following action: a sitter identifies their optimal midline alignment according to their comfort, muscular tone, and balance. A sitter simply maintains their identified optimal midline alignment while balancing on the seat over the Central Stability Area 25 of the Bottom Surface of the Top Tier 17. No motion is indicated with respect to the Four-Tier Seat Base 2 when seated in a stable mode.

To perform active tasks requiring a forward lean, such as reaching, eating, keyboarding or playing a musical instrument, sitters take the following actions on the seat. A sitter identifies their optimal midline alignment according to their comfort, muscular tone, and balance. A sitter tips their upper body weight forward without changing the alignment of their pelvis in the seat, i.e., torso, pelvis, seat pan and supporting column become a stable, single unit. The seat responds by rocking forward onto the Slanted Convex Surface of the Bottom Surface of the Top Tier 27. A sitter maintains a secure alignment at the interface of the pelvis and seat pan while continuing to tip the base of the seat forward until they reach an optimal amount of forward tilt for the task at hand. The sitter remains at that angle until the task is completed. During this time sitter's legs remain slightly active in order to maintain the forward tilt and a dynamic tripod base of support with the seat base. When the sitter needs to return to the upright position they do so by giving a slight backward push on their feet; this push returns the seat and sitters to a midline stable position over the Center Stability Area of the Bottom Surface of the Top Tier 25.

To perform active tasks requiring a sideward lean, such as reaching for a telephone or pencil on a desk, sitters take the following actions on the seat: the sitter identifies their optimal midline alignment according to their comfort, muscular tone, and balance. The sitter tips their upper body weight sideward without changing the alignment of their pelvis in the seat, i.e., torso, pelvis, seat pan and supporting column become a stable, single unit. The seat responds by rocking sideward onto the Slanted Convex Surface of the Bottom Surface of the Top Tier 27. The sitter maintains a secure alignment at the interface of the pelvis and seat pan while continuing to tip the base of the seat sideward until they reach an optimal amount of sideward tilt for the task-at-hand. The sitter remains at that angle until the task is completed. During this time sitter's legs remain slightly active in maintaining the sideward tilt and a dynamic tripod base of support with the seat base. When the sitter needs to return to the upright position they do so by giving a slight counter-push on their feet; this push returns the seat and sitters to a midline stable position over the Center Stability Area of the Bottom Surface of the Top Tier 25.

To perform active tasks requiring a diagonal lean, combining a forward and sideward lean, such as reading or writing on a desk surface, sitters take the following actions. The sitter identifies their optimal midline alignment according to their comfort, muscular tone, and balance. The sitter tips their upper body weight simultaneously forward and sideward in a diagonal pathway as needed without changing the alignment of their pelvis in the seat, i.e. torso, pelvis, seat pan and supporting column become a stable, single unit. The seat responds by rocking both forward and sideward onto the Slanted-Convex Surface of the Bottom Surface of the Top Tier 27. The sitter maintains a secure alignment at the interface of the pelvis and seat pan while continuing to tip the base of the seat diagonally until they reach an optimal amount of diagonal tilt for the task-at-hand. The sitter remains at that angle until the task is completed. During this time sitter's legs remain slightly active in maintaining the diagonal tilt and a dynamic tripod base of support with the seat base. When the sitter needs to return to the upright position they do so by giving a slight counter-push on their feet; this push returns the seat and sitters to a midline stable position over the Center Stability Area of the Bottom Surface of the Top Tier 25.

To perform active tasks requiring the use of sitters' right and left sides alternately, such as sorting papers at a desk, or playing a musical instrument, such as a piano, sitters take the following actions. The sitter identifies their optimal midline alignment according to their comfort, muscular tone, and balance. The sitter tips their upper body weight diagonally as needed without changing the alignment of their pelvis in the seat, i.e., the pelvis, seat pan and supporting column become a stable single unit. The seat responds by rocking diagonally onto the Slanted Convex Surface of the Bottom Surface of the Top Tier 27. During this action sitter will alternate between rocking diagonally to right of center and diagonally to left of center in a motion that follows a lemniscate (figure-eight) shape. The sitter alternates moving between diagonal angles right and left of center until the task is completed. During this time sitter's legs remain slightly active in maintaining the diagonal tilt and a dynamic tripod base of support with the seat base. When the sitter needs to return to the upright position they do so by giving a slight counter-push on their feet; this push returns the seat and sitters to a midline stable position over the Center Stability Area of the Bottom Surface of the Top Tier 25.

When the sitter needs to turn the seat so as to face a different direction they do so by taking the following action: The sitter turns the seat from its base at the Lazy Susan Mechanism 11 located between the Bottom Tier and the Middle Tier of the Four Tier Seat Base while maintaining their position of choice. There is no need to twist the body; the sitter and the seat will turn together. The sitter turns the seat by moving their feet on the floor sideward, one at a time as if walking, and the seat will follow them along. When the seat faces the desired direction the position of Top Tier of the Four Tier Seat Base 16 remains intact and sitter can tip forward or sideward or both as needed by using the motions describe above. When the sitter wants to return to the former position they turn the seat from the base in the opposite direction by moving their feet.

To move the seat from place to place the sitter rises off the seat and moves it manually by sliding it along the floor or picking it up from the seat pan using the Anterior and Posterior Indentations, 40 and 41 respectively, on the Bottom Surface of the Contoured Seat Pan 39.

There are many design features that can be altered either singly or in combination with each other in the design of this seat. New features can be added as well. The following are several alternative embodiments of the seat of the present invention.

An alternative embodiment comprises an increase in width, depth, or both to accommodate a wider range of individual pelvic dimensions.

A further alternative embodiment comprises a Gas Cylinder 5 of increased or decreased height to accommodate a wider range of individual heights, from children to tall adults.

A further alternative embodiment comprises a seat constructed of materials and to specifications necessary to meet bariatric standards to accommodate the need of persons with increased weight considerations.

A further alternative embodiment comprises a seat constructed with the handle for the Gas Cylinder Release and Seat Mounting Unit 6 to the left hand side of the Contoured Seat Pan 7 to accommodate left-handed individuals.

A further alternative embodiment comprises a seat constructed with an increase in the anterior angle to a maximum of about 8 degrees of the Non-Vertical Supporting Column between the Gas Cylinder Mount 4 and Top Tier of the Four-Tier base 16.

A further alternative embodiment comprises a seat constructed to allow a greater or lesser amount of forward and sideward tilting motion at the Slanted and Convex Surface of the Bottom Surface of the Top Tier 17 of the Four-Tier Seat Base 2.

A further alternative embodiment comprises a seat constructed to allow a greater or lesser amount of slant to allow forward rocking motion within the Slanted Convex Surface of the Bottom Surface of the Top Tier 27 of the Four-Tier Seat Base 2.

A further alternative embodiment comprises a seat constructed to allow a greater or lesser amount of convexity within the Slanted Convex Surface of the Bottom Surface of the Top Tier 27 of the Four-Tier Seat Base 2.

A further alternative embodiment comprises a seat constructed such that the Four-Tier Base 2 is reduced to include only three tiers, i.e., the Bottom Tier 8, the Lazy-Susan Mechanism 11 and the Middle Tier 13. In this case the Bottom Tier 8 would make direct contact with the floor. The only motion available at the Seat Base would, in this case, be rotation.

A further alternative embodiment comprises a seat constructed with the elimination of the Bottom Tier 8, the Middle Tier 13 and the Lazy-Susan Mechanism 11. In this case the Top Tier 16 of the Four-Tier Seat Base 2 makes direct contact with the floor, preserving the rocking motion available from the Bottom Surface of the Top Tier 17 and eliminating the rotational motion available within the Seat Base.

A further alternative embodiment comprises a seat constructed with the elimination of the Top Tier 16 of the Four-Tier Seat Base 2, thereby eliminating the rocking motion, but including the Lazy-Susan Mechanism 11 and rotational motion between the Bottom Tier 8 and Middle Tier 13 of the Four-Tier Seat Base 2.

A further alternative embodiment comprises a seat constructed with casters, comparable rolling mechanisms or sliders attached to the Bottom Surface of the Bottom Tier 9 of the Four-Tier Seat Base 2 so that the Seat can roll or slide easily from location to location.

A further alternative embodiment comprises a seat constructed with cleats of specified and graduated heights attached to the bottom of the Contoured Seat Pan 7 prior to attaching the Gas Cylinder Release 6 as a means of increasing the height of the Seat.

A further alternative embodiment comprises a seat constructed such that the Non-Vertical Central Supporting Column 3 is mounted vertically at 90° to the floor while preserving the rocking and rotational motions available at Bottom Surface of the Top Tier 17 and the Lazy-Susan Mechanism 11.

A further alternative embodiment comprises a seat constructed to include cleats on the Bottom Surface of the Seat Pan 39 to facilitate moving the seat from location to location.

A further alternative embodiment comprises a seat constructed of materials other than wood, such as metal, plastic, or fiberglass, for example, that are both light and moldable.

A further alternative embodiment comprises a seat constructed with cushioning on the seat pan.

Although this invention has been described with respect to specific embodiments, it is not intended to be limited thereto and various modifications which will become apparent to the person of ordinary skill in the art are intended to fall within the spirit and scope of the invention as described herein taken in conjunction with the accompanying drawings and the appended claims.

The invention claimed is:

1. A seat comprising:

a base, a single non-vertical central supporting column rockingly supported on the base to rock from a central stability position in an anterior direction and in two opposed sideways directions but impeded from rocking from the central stability position in a posterior direction, sloping upwardly in the anterior direction at an angle of between 2° and 5° when in the stability position, and a contoured seat pan supported on the base through the non-vertical central supporting column and wherein the seat pan is positioned over a middle of the central supporting column, has a bottom seat pan surface, and is fixed to and supported on a top end of the non-vertical central supporting column, wherein a support axis passes through the top end and a bottom end of the non-vertical central supporting column and through the bottom seat pan surface.

2. The seat of claim 1 wherein the base comprises a four tier base comprising a bottom tier contacting the floor or ground, a Lazy Susan mechanism supported on the bottom tier, a middle tier supported on and rotating with the Lazy Susan mechanism, and a top tier supported above and by the middle tier and rocking on the middle tier and vertically attached to the middle tier.

3. The seat of claim 2 wherein the bottom tier comprises a flat bottom surface and a flat top surface, and wherein the flat bottom surface of the bottom tier contacts the floor or ground, and wherein the top surface of the bottom tier is attached to a bottom surface of the Lazy Susan mechanism and further comprising a member passing through central portions of the top surface of the middle tier and of a bottom surface of the top tier to vertically attach together the middle and top tiers.

4. The seat of claim 3, wherein the member comprises a threaded member which additionally passes through a central portion of the top tier to hold the bottom, middle, and top tiers together as a unit.

5. The seat of claim 2 wherein the Lazy Susan mechanism is attached to a top surface of the bottom tier.

6. The seat of claim 2 wherein the middle tier has an essentially flat top surface and an essentially flat bottom surface and the bottom surface of the middle tier is attached to a top surface of the Lazy Susan mechanism and the top surface of the middle tier is attached to a bottom surface of the top tier such that the center of the Lazy Susan mechanism and the center of the bottom tier and the center of the middle tier are congruent.

7. The seat of claim 2 wherein the top tier has a contoured bottom surface and a top surface and the contoured bottom surface of the top tier is rockingly attached to, rockingly contacting, and supported on a top surface of the middle tier, and wherein the contoured bottom surface of the top tier is symmetrically contoured with respect to the sagittal plane, from right to left, to allow rocking of the top tier on the middle tier from right to left across the sagittal plane and is asymmetrically contoured with respect to the frontal plane, from front to back, to allow reciprocal rocking of the top tier on the middle tier in a forward direction from the central stability position but to impede rocking of the top tier on the middle tier in a rearward direction from the central stability position, and the top surface of the top tier is essentially flat except for an indented central region wherein this region is cut at angle, sloping downward from the back to the front of the top tier to accommodate a support base for the non-vertical central supporting column.

8. The seat of claim 2, wherein the Lazy Susan mechanism comprises a mechanism selected from the group of (1) ball bearings in a circular race and (2) a disc inside a disc.

9. The seat of claim 2, wherein a member passing through central portions of the top and middle tiers vertically and rockingly attaches the top tier to the middle tier.

10. The seat of claim 1, wherein the non-vertical central supporting column comprises three components:

a) a gas cylinder mount comprising an internally tapered tube welded to a flat circular base, wherein the base includes holes for screws or other attachment means, and wherein the mount fits into an indented central region on a top surface of the a top tier of the base;

b) a gas cylinder; and c) a gas cylinder release and seat pan mounting unit.

11. The seat of claim 1 wherein the contoured seat pan has a top seat pan surface which slopes slightly downward from the posterior to the anterior aspects at a second angle and further wherein the top seat pan surface comprises five additional contours:

a) posterior sacrum/coccyx supporting surface;

b) right and left "sit bone" concave contours;

c) central pelvic floor indentations;

d) right and left lateral upper thigh supports; and e) elevated midline contour; and wherein the seat pan is shaped in a triangular configuration, with an increase in width at the front of the seat to accommodate the shape of the combined pelvis and thighs, and wherein the back edge of the seat pan is higher than the front edge, thus creating the approximately two degree tilt within the seat pan itself.

12. The seat of claim 11, wherein the posterior sacrum/coccyx supporting surface molds the shape of the buttocks and provides a surface for the sacrum to rest against.

13. The seat of claim 11, wherein the side edges of the seat pan are slightly tilted toward the center of the seat pan, thus encouraging the thighs to fall forward from the hip joint rather than in an open or abducted pathway and wherein the right and left "sit bone" concave contours receive the "sit bones" of a sitter, and further wherein in front of this indentation is a slight rise to support the length of the thigh just anterior to the "sit bone".

14. A seat, comprising:

a seat pan contoured to receive a sitter facing in a forward direction;

a base configured to rest on a floor, wherein the upper portion of the base is rockable on a lower portion of the base from a stability position in the forward direction and in opposed sideway directions transverse to the forward direction but is impeded from rocking from the stability position in a rearward direction opposite the forward direction; and a support member fixed to a bottom of the seat pan and to an upper portion of the base, and supporting the seat pan on the base, wherein a support axis passes through a top and a bottom of the support member and through the bottom of the seat pan and extends upwardly and forwardly from the bottom of the support member at an angle of between 2° and 8° when the upper portion of the base is in the stability position.

15. The seat of claim 14, wherein the lower portion of the base is rotatable on a lowermost portion of the base.

16. The seat of claim 14, wherein the upper portion of the base is inhibited from rotating about a vertical axis with respect to the lower portion.

17. A seat, comprising:

a seat pan contoured to receive a sitter facing in a forward direction;

a base including a first tier configured to be supported on a floor, a second tier rotatably supported on the first tier, a third tier rockably fixed to the second tier and rockable on the second tier from a central stability position in the forward direction and in opposed lateral directions but inhibited from rocking from the central stability position in a posterior direction opposite the forward direction; and a support member having top and bottom ends fixed to a bottom of the seat pan and a top of the third tier respectively.

18. The seat of claim 17, wherein a support axis passes extends upwardly and forwardly from the bottom end extends through the top end and the bottom of the seat pan.

19. The seat of claim 17, wherein the rocking of the third tier on the second tier is enabled by an interface of rocking contact between a bottom surface of the third tier and a top surface of the second tier that is symmetric with respect to a sagittal plane and asymmetric with respect to a frontal plane.

20. The seat of claim 17, wherein the support member, when the third tier is in the stability position, slopes in the forward direction at an angle of between 2° and 5°.

* * * * *